US008691305B2

(12) United States Patent
Markovic

(10) Patent No.: US 8,691,305 B2
(45) Date of Patent: Apr. 8, 2014

(54) FOLDED DUAL SPLIT PACKAGE

(75) Inventor: Nevenka Markovic, Nutley, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/380,452

(22) PCT Filed: Jun. 23, 2010

(86) PCT No.: PCT/US2010/039667

§ 371 (c)(1), (2), (4) Date: Mar. 12, 2012

(87) PCT Pub. No.: WO2010/151594

PCT Pub. Date: Dec. 29, 2010

(65) Prior Publication Data

US 2012/0164284 A1 Jun. 28, 2012

Related U.S. Application Data

(60) Provisional application No. 61/269,323, filed on Jun. 23, 2009.

(51) Int. Cl.
*B65D 77/02* (2006.01)
*B65D 25/04* (2006.01)

(52) U.S. Cl.
USPC ..... 426/115; 426/108; 229/120.9

(58) Field of Classification Search
USPC ..... 426/5, 115, 108, 106; 206/800, 526, 206/192, 525.1, 738, 739, 745, 747, 774, 206/784; 229/120.02, 120.011, 120.09, 229/148, 149
See application file for complete search history.

(56) References Cited

U.S. PATENT DOCUMENTS

| | | | | |
|---|---|---|---|---|
| 1,726,108 | A * | 8/1929 | Hughes | 229/120.012 |
| 2,046,484 | A * | 7/1936 | Ringler | 206/256 |
| 2,074,451 | A | 3/1937 | Berberian | |
| 2,651,449 | A * | 9/1953 | Burnett | 229/120.01 |
| 4,294,353 | A * | 10/1981 | Focke et al. | 206/273 |
| 5,141,106 | A | 8/1992 | Adams et al. | |
| 5,178,269 | A * | 1/1993 | Evers | 206/256 |
| 5,178,271 | A | 1/1993 | Adams et al. | |

(Continued)

FOREIGN PATENT DOCUMENTS

| | | |
|---|---|---|
| CN | 1968857 B | 10/2010 |
| JP | Z0000046573 | 9/1919 |

(Continued)

OTHER PUBLICATIONS

Chinese Search Report with English translation issued in corresponding Chinese application No. 201080037182.X.

*Primary Examiner* — Viren Thakur
*Assistant Examiner* — Sophia Leung
(74) *Attorney, Agent, or Firm* — Hoffmann & Baron, LLP

(57) ABSTRACT

The present invention provides a package assembly for enclosing and dispensing a plurality of consumable products. The package assembly includes a package housing defining a pair of product pockets each having an open end for removably accommodating a plurality of products in an aligned array. The open ends of the pockets are in facing orientation. The package housing includes a fold line between the open ends of the pocket for folding the housing thereat and placing the pockets in an angled orientation for dispensing of product. The housing further defines at least one openable flap for overlying and enclosing the pockets.

21 Claims, 7 Drawing Sheets

(56) References Cited

U.S. PATENT DOCUMENTS

| | | | | | |
|---|---|---|---|---|---|
| 5,201,413 | A | | 4/1993 | DeBlasio et al. | |
| 5,251,748 | A | * | 10/1993 | Adams et al. | 206/256 |
| 5,261,533 | A | * | 11/1993 | Adams et al. | 206/273 |
| 5,533,667 | A | * | 7/1996 | Gale | 229/120.01 |
| 5,938,022 | A | | 8/1999 | Detloff | |
| 6,837,369 | B2 | * | 1/2005 | Amos | 206/273 |
| 7,325,686 | B2 | * | 2/2008 | Aldridge | 206/460 |
| 2003/0080020 | A1 | | 5/2003 | Kopecky | |
| 2005/0252809 | A1 | * | 11/2005 | Aldridge et al. | 206/449 |
| 2008/0053858 | A1 | | 3/2008 | Glydon et al. | |
| 2009/0134053 | A1 | | 5/2009 | Jeannin et al. | |

FOREIGN PATENT DOCUMENTS

| | | | | | |
|---|---|---|---|---|---|
| JP | S55-115929 | | 2/1979 | | |
| JP | 56-24425 | | 8/1979 | | |
| JP | 6-48438 | | 2/1994 | | |
| JP | 2000-109064 | * | 4/2000 | | B65D 5/54 |
| JP | 2007-191170 | | 8/2007 | | |
| JP | 2008-501586 | | 1/2008 | | |
| JP | U3147401 | | 12/2008 | | |
| NL | 6 609 564 | A | 7/1967 | | |
| WO | 2008/153954 | A1 | 12/2008 | | |
| WO | WO 2008/153953 | A1 | 12/2008 | | |

* cited by examiner

FOLDED DUAL SPLIT PACKAGE

This application claims the benefit of priority to U.S. Provisional Patent Application Ser. No. 61/269,323 filed on Jun. 23, 2009, the disclosure of which is incorporated by reference herein in its entirety for all purposes.

FIELD OF THE INVENTION

The present invention relates generally to a package assembly for containing and dispensing consumable products. More specifically, the present invention relates to a package for dispensing gum slabs in two spaced apart rows.

BACKGROUND OF THE INVENTION

There exists in the prior art numerous packages which contain consumable products such as chewing gum pieces. Many of these packages provide both aesthetic and functional features which make the package desirable to the consumer. Certain of the desirable features include an aesthetically designed packaging cover which overlies an open portion of the package and is openable to expose the gum pieces for dispensing. Certain of the functional features include the ability to retain the gum pieces in one or more aligned arrays which allow for convenient individual dispensing of the gum pieces.

It is desirable to provide improved gum packaging which, while maintaining the aesthetically pleasing appearance, provides superior functionality to the consumer.

SUMMARY OF THE INVENTION

The present invention provides a package assembly for enclosing and dispensing a plurality of consumable products. The package assembly includes a package housing defining a pair of product pockets each having an open end for removably accommodating a plurality of products in an aligned array. The open ends of the pockets are in facing orientation. The package housing includes a fold line between the open ends of the pocket for folding the housing thereat and placing the pockets in an angled orientation for dispensing of product. The housing further defines at least one openable flap for overlying and enclosing the pockets.

The present invention also provides a consumable products package assembly including a package housing defining a pair of product pockets each having an open end for removable accommodation of plural products. The package includes a fold line disposed between the open ends of the pockets for folding the housing thereat. The housing has a first position wherein the pockets lie in a common plane and a second position wherein the housing is folded along the fold line and the pockets are angularly offset from each other.

The present invention further provides a consumable products package assembly including a plurality of consumable product pieces. The package assembly includes a package housing which defines a first product pocket and a second product pocket each having an open end for removable accommodation of the plurality of product pieces. The package includes a fold line disposed between the open ends of the pockets for folding the housing thereat. The housing having a first position wherein the first and second pockets lie in a common plane and a second position the pockets are angularly offset form each other.

DETAILED DESCRIPTION OF THE PREFERRED EMBODIMENT

The present invention provides a package assembly for enclosing and dispensing a plurality of products, preferably consumable products. More particularly, the present invention is designed to contain and dispense confectionery products such as gum pieces. While multi-layered gum slabs are shown in the preferred embodiments of the present invention, it may be appreciated that the package disclosed herein may be used to dispense a wide variety of consumable products such as gum pieces in many forms. It is contemplated that the package assembly of the present invention may be used to contain and dispense gum pieces in various shapes, including slabs, sticks, pellets, pillows and the like. In addition, unwrapped gum slabs are shown in the preferred embodiments herein and it is within the contemplation of the present invention that the individual gum pieces may be wrapped or unwrapped.

Figure 1:
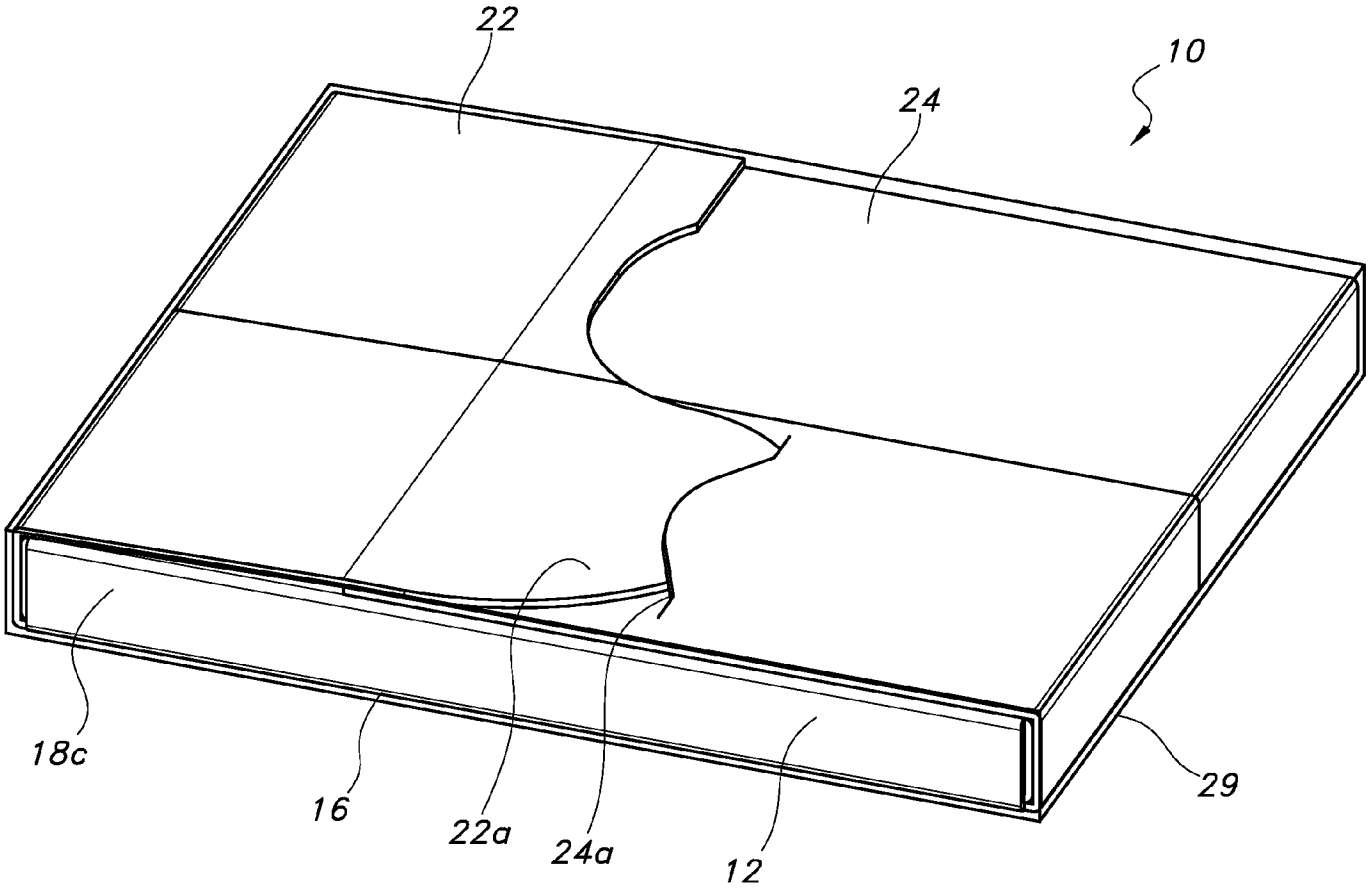
FIG. 1 is top perspective view of a package assembly of the present invention shown in closed condition.
Figure 2:
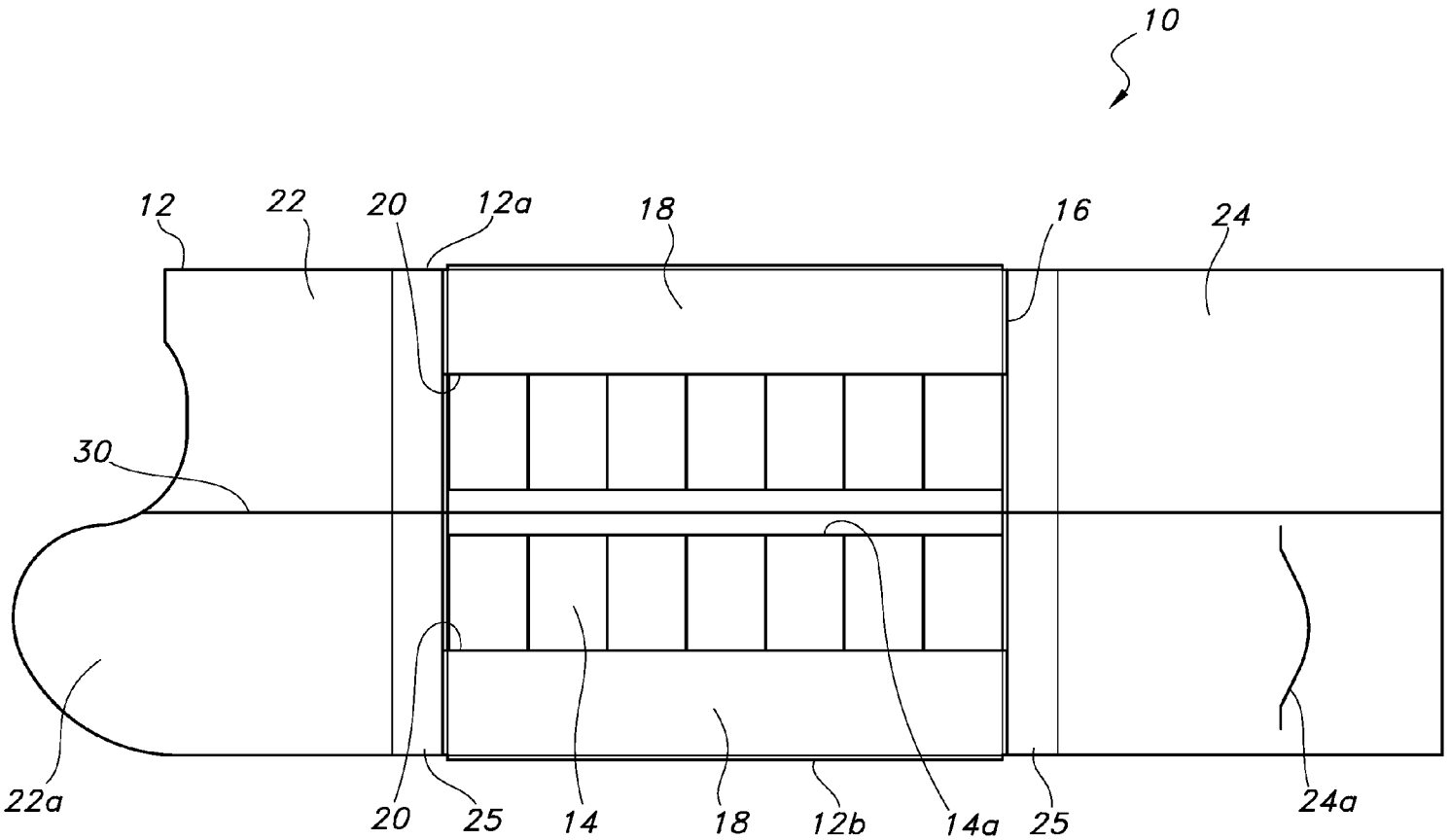
FIG. 2 is a top plan view showing the package assembly in a fully open position.

With reference to FIGS. 1 and 2, the package assembly 10 of the present invention includes a package housing 12 and a plurality of gum slabs 14 arranged in two side-by-side arrays. In the present illustrative embodiment, two rows of seven gum slabs are shown. However, it may be appreciated that any number of gum slabs may be employed in combination with the present invention. The gum slabs may be either individually covered in a wrapper, or left uncovered.

The package housing 12 includes a back wall 16 supporting a pair of open ended pockets 18. The pockets each include an open end 20 which are spaced apart and in facing orientation. The pockets 18 each include a front wall 18*a* bounded by two opposed side walls 18*b* and a bottom wall 18*c*. The front wall, side walls and bottom wall define a cavity 18*d* for accommodating the gum slabs in the two rows. The pockets bottom walls 18*c* support the slabs and form the side walls of the package housing 12 as shown in FIG. 1. The pockets 20 are of sufficient depth to hold the slab's lower extent 14*b*, yet leave an upper extent 14*a* of the slabs exposed for dispensing (FIG. 4).

Extending from opposite ends of back wall 16 is a pair of flaps 22 and 24. The flaps are designed to be foldable over the pockets 18 in opposition to the back wall 16 to enclose the gum slabs 14 contained within the pockets. As is shown in FIG. 1, the flaps 22 and 24 may overlie each with a portion of flap 24 lying below a portion of flap 22. Flap 22 includes an extending tab 22*a*, and flap 24 includes a mating slot 24*a* so as to maintain the flaps in closed condition. Various different configurations of the tabs and slots are within the contemplation of the present invention. When the flaps are folded to a fully closed position wherein they overly each other, the pockets and gum slabs 14 held therein are covered. The flaps each include a segment 25 disposed adjacent to the back wall 16 which forms end wall of the package housing 12 when the flaps are in the closed position.

As shown in FIG. 1, the package housing 12 having gum pieces therein may be covered with a removable overwrap 29 to protect the contents of the package housing. A user may remove the overwrap 29 to access the pockets 18 and gum pieces 18 therein.

Figure 3:
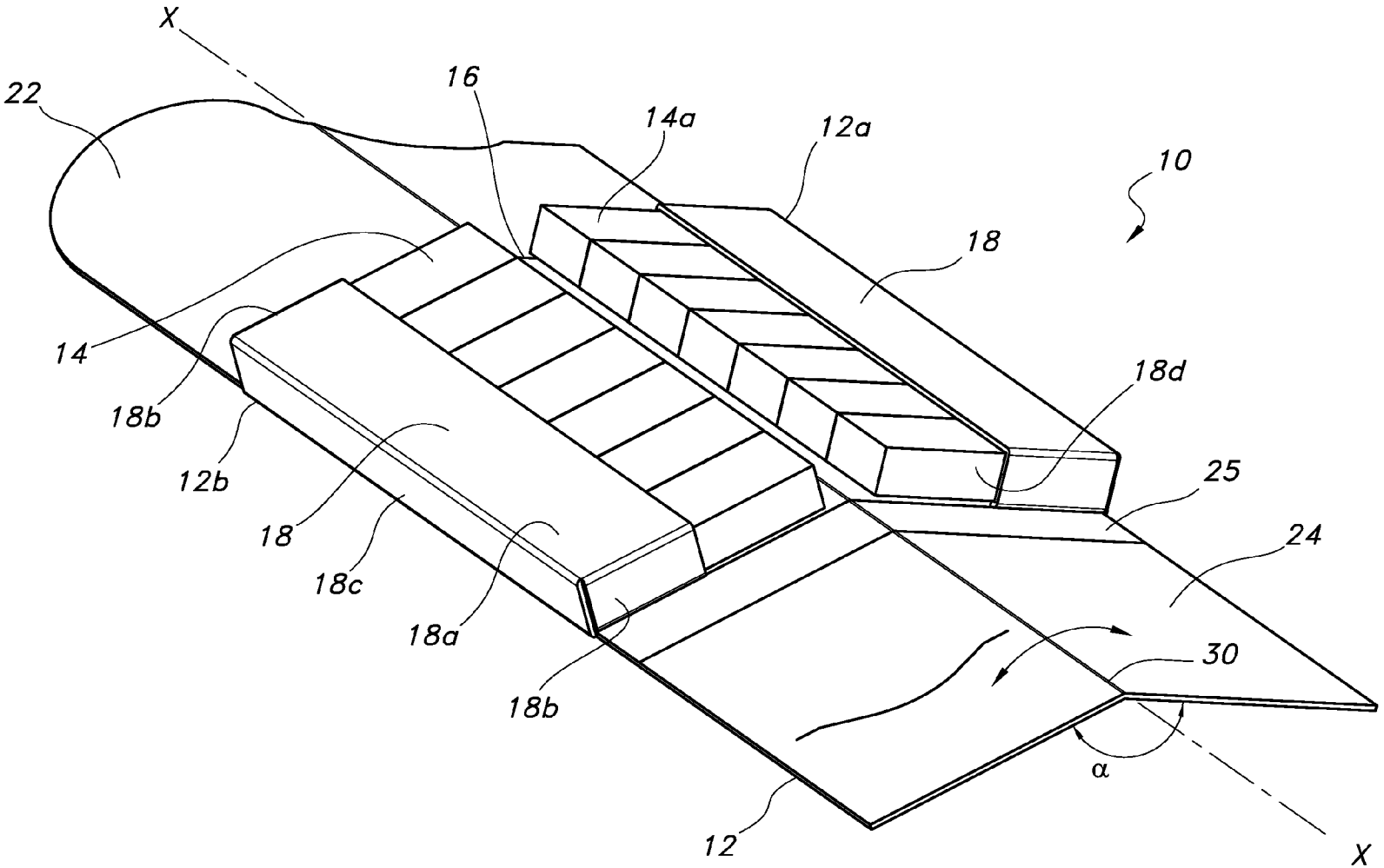
FIG. 3 is a top perspective view showing the package assembly of FIG. 1 in a folded condition for dispensing of gum slabs therefrom.
Figure 4:
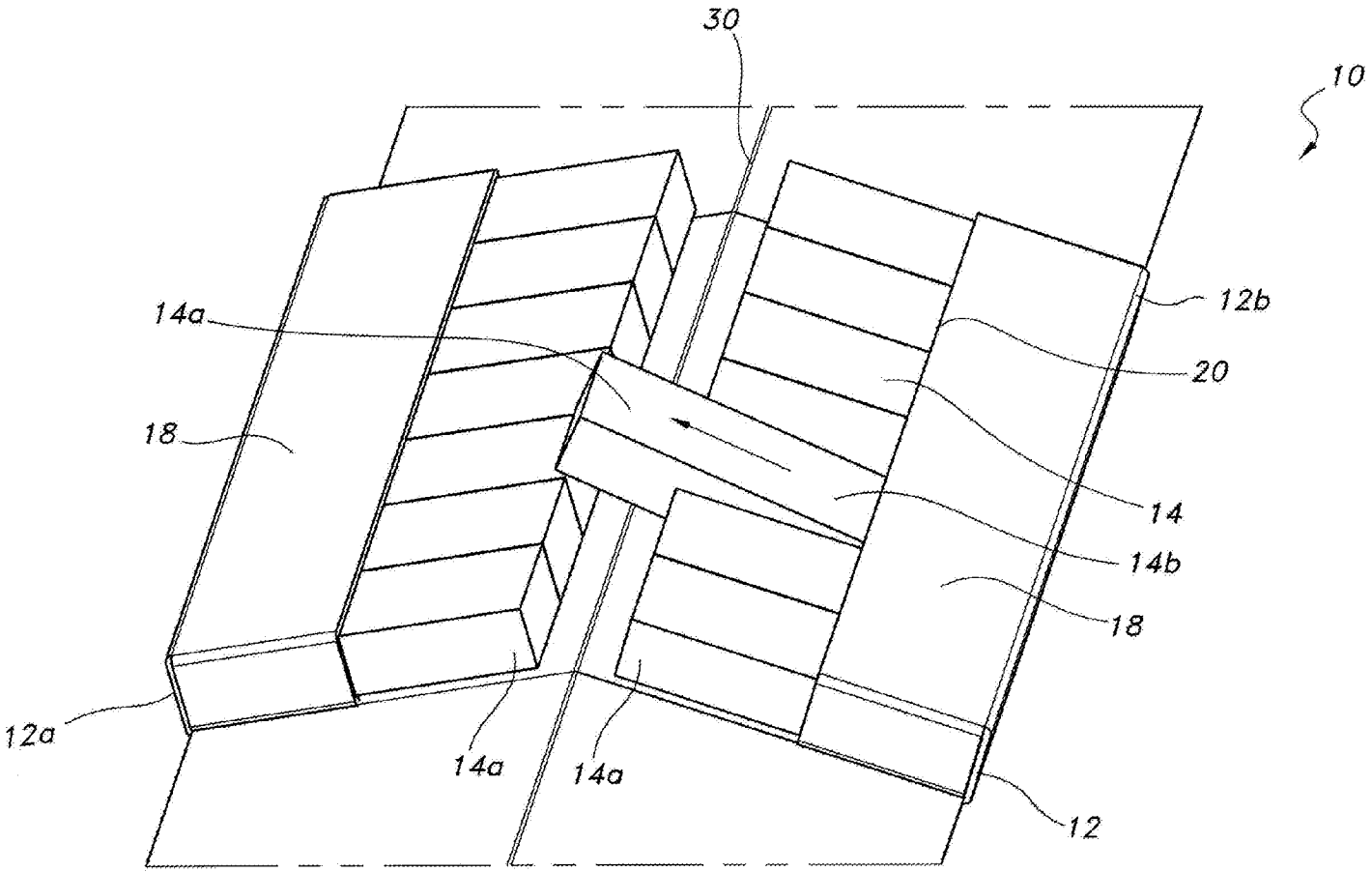
FIG. 4 is a partial top perspective view showing the package assembly of FIG. 1 folded and one gum slab being dispensed therefrom.

Referring to FIGS. 2-4, use of the package housing 12 to dispense gum slabs 14 is shown. The two flaps 22 and 24 are open to a position substantially planar with the back wall 16. In the open position shown in FIG. 2, the gum slabs 14 are uncovered and are accessible for dispensing. Thereafter, the package housing may be folded longitudinally along fold line 30 which is created between open ends 20 of pockets 18 as shown in FIGS. 3 and 4. The fold line 30 may be aligned with a longitudinal axis X-X of the opened package housing 12. The fold line may divide the package housing generally in half lengthwise forming a first half 12*a* and a second half 12*b*. The housing 12 is folded such that the pockets 18 moved out of the common plane and are placed in an angled orientation with respect to each other. A shown in FIG. 3, the angle $\alpha$ between the pockets is less than 180 degrees. It is contemplated that the housing 12 may be further folded about the fold line 30 so that the products are generally side-by-side so that the gum slabs 14 supported within the pockets extend in a mutually upward position.

As shown in FIG. 4, the angled position of the pockets 18 separates the upper extents 14*a* of the gum slabs 14 of one row from the adjacent row to allow manual dispensing of one or more gum slabs 14 from the pockets 18 as shown in FIG. 4. Once the desired number of gum slabs are dispensed by the user, the back wall can again be made flat, as shown in FIG. 2, and the flaps 22 and 24 can be folded to a closed condition with tab 22*a* placed in slot 24*a* thereby closing the remaining gum slabs 14 contained therein as shown in FIG. 1.

Figure 5:
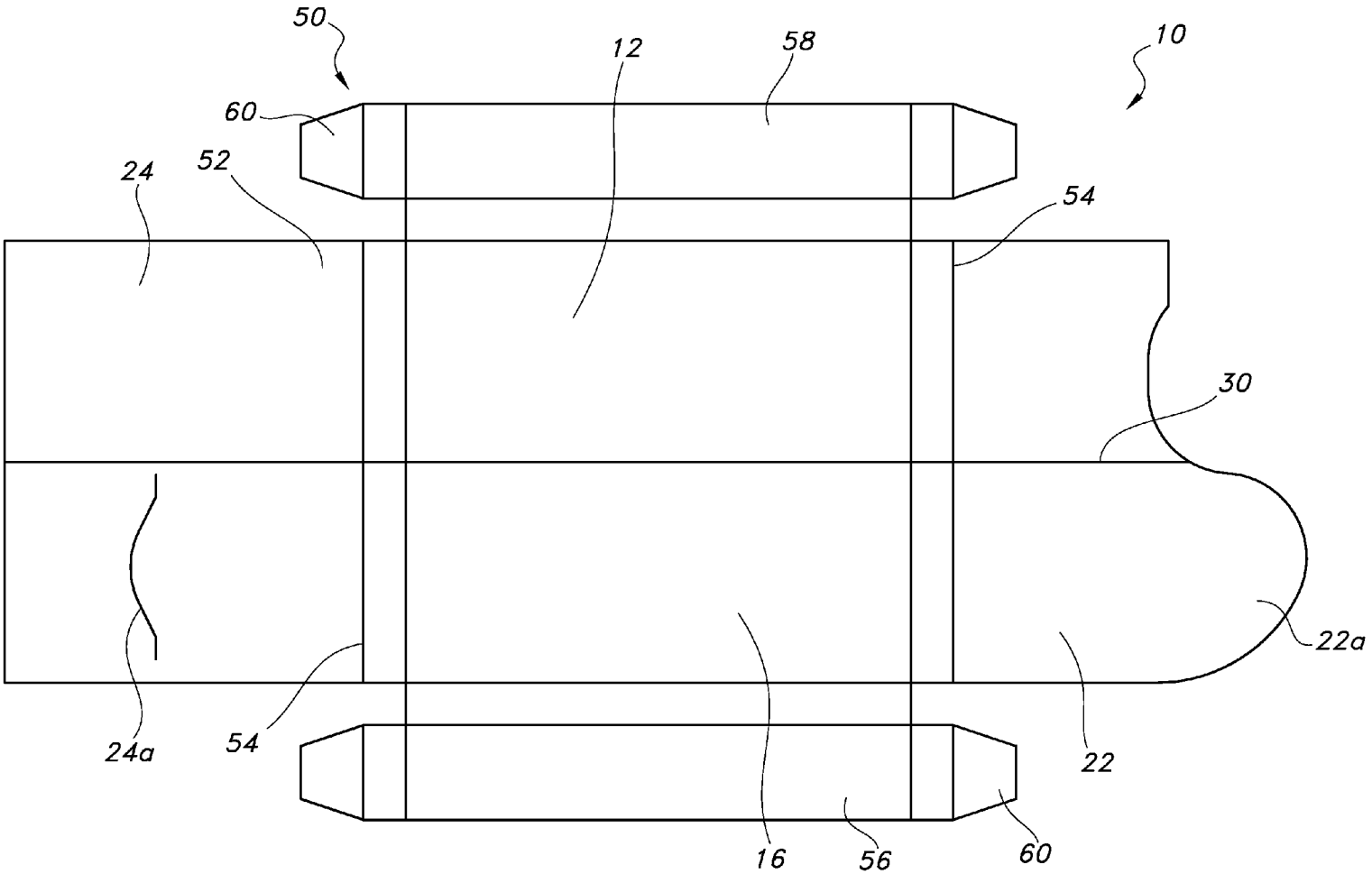
FIG. 5 is a plan view of a flat blank used to form the package assembly of FIG. 1.

Preferably, as shown in FIG. 5, the package housing 12 may be formed from a single unitary flat blank 50 of paperboard or other materials including composites thereof. A main panel 52 may be folded along fold lines 54 to form the back wall 16 and flaps 22 and 24. A first and second side panels 56 and 58 may extend form opposite sides of the main panel 52. The side panels 56 and 58 may be folded over the back wall 16 to form the pockets 18. The side panels may each include a pair of tabs 60 which may be folded and adhered to the back wall 16 to secure the pockets 18 in place. The longitudinal fold line 30 may extend along the entire length of the blank 50.

Figure 6:
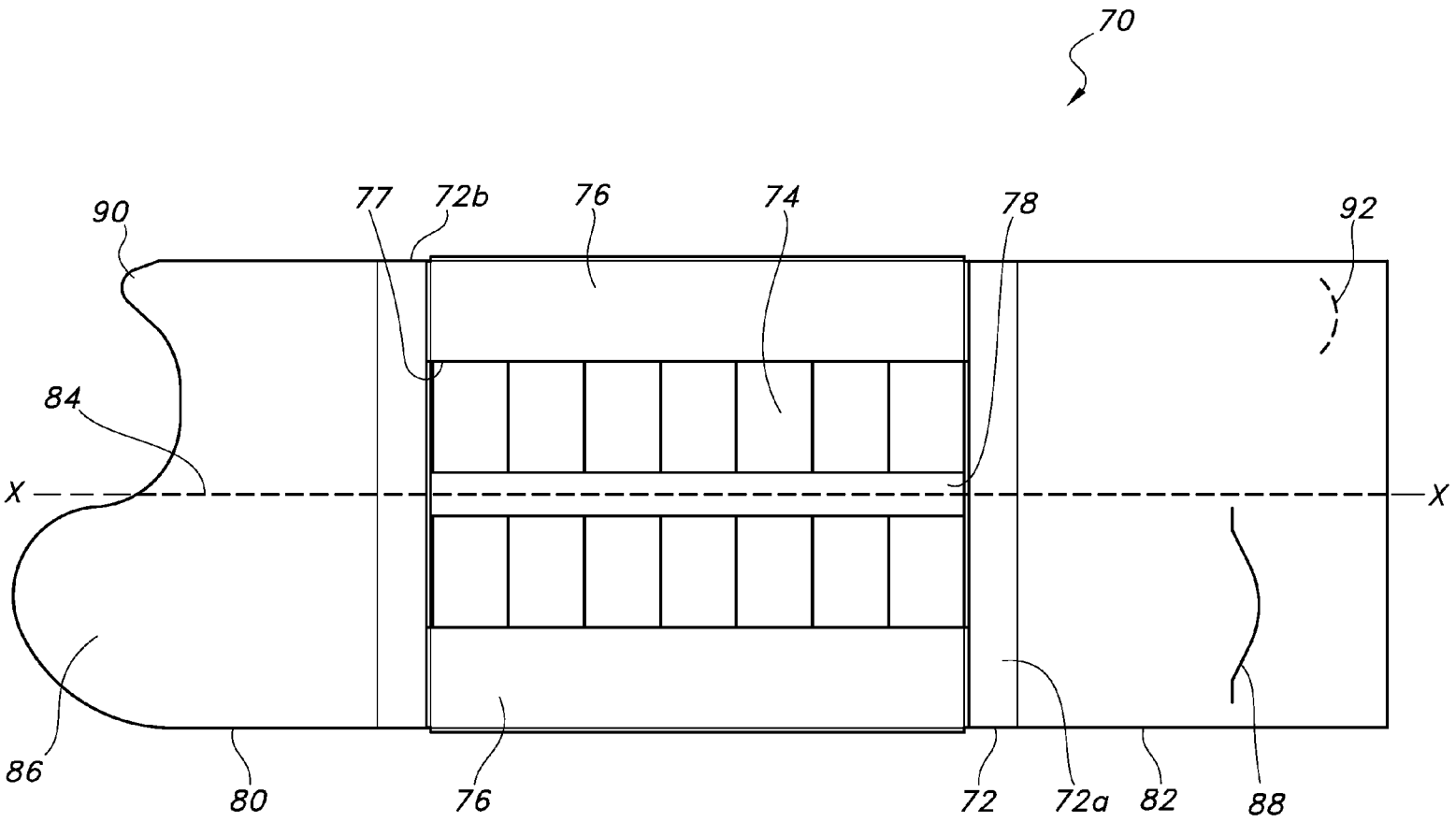
FIG. 6 is a top plan view of an alternative embodiment of the present invention showing a package assembly in the fully open position.
Figure 7:
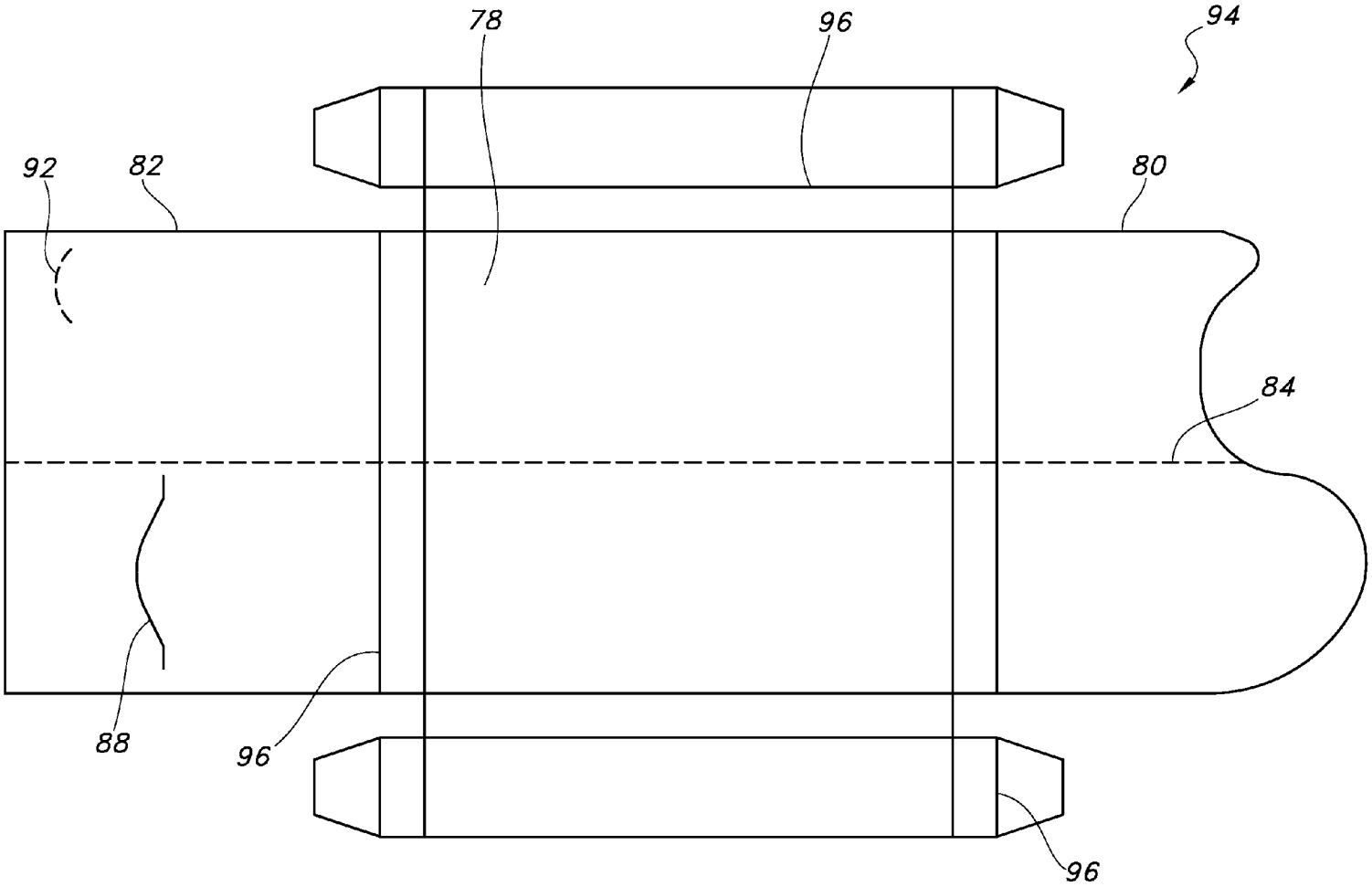
FIG. 7 is a plan view of a flat blank used to form the alternative embodiment of the package assembly of FIG. 6.

An alternative embodiment of the present invention is shown in FIGS. 6 and 7. With specific reference to FIG. 6, the package assembly 70 includes a package housing 72 and a plurality of gum slabs 74 arranged in two side-by-side arrays. This embodiment is similar to that described above, and includes pockets 76 having an open end 77 which are spaced apart and in facing orientation for retaining the gum slabs 74. Extending from opposite ends of a back wall 78 is a pair of flaps 80 and 82. The flaps are designed to be foldable over the pockets 76 in opposition to the back wall 78 to enclose the gum slabs 74 contained within the pockets.

With further reference to FIG. 6, the package housing 72 may be folded longitudinally along fold line 84 which is created between open ends 77 of pockets 76 in a manner similar to the previously described embodiment shown in FIGS. 1-5. The fold line 84 may be aligned with a longitudinal axis X-X of the opened package housing 72. The fold line may divide the package housing generally in half lengthwise forming a first half 72*a* and a second half 72*b*. The folding of the package housing 72 along fold line 84 assists in the dispending of the gum slabs 74 as in a manner described above.

In the alternative embodiment shown in FIG. 6, the fold line 84 is perforated in order to permit a user to longitudinally separate the package housing first half 72*a* from the second half 72*b*. Accordingly, a user may separate the package housing 72 to make two smaller packages each having a pocket for retaining gum slabs. This may be desirable if a user wants to share part of the package with another. In addition, after the gum slabs are all removed from one pocket, the empty package housing half may be torn off and discarded. The remaining gum slabs may therefore be retained in a smaller package which is easier to store and access.

In order to permit each packaging housing half 72*a* and 72*b* to be closed, the flaps 80 and 82 may include two closures, one disposed on the package housing first half 72*a* and another disposed on the package housing second half 72*b*. The first half closure may include a first tab 86 extending from flap 80 and a first slot 88 formed in flap 82. The second half closure may include a second tab 90 extending from flap 80 and a second slot 92 formed in flap 82. When the package halves are separated the flaps may be folded over the gum slabs and the tabs may be inserted into their respective slot to keep the flaps in the closed position. One of the tabs, e.g., first tab 86, may be larger than the other tab and be used along with its corresponding first slot 88 to maintain the flaps together when both package housing halves 72*a* and 72*b* are secured together. The second slot 92 may be formed by a perforation. The second slot 92 would only be opened by a user after the package housing halves were separated and the user desired to use the second slot 92 to secure second tab 90 to retain the package half in the closed position.

With specific reference to FIG. 7, the package housing 72 may be formed from a single unitary blank 94. The blank 94 may be folded around fold lines 96 in a manner similar to the blank 50 shown in FIG. 5 and described above. The perforated fold line 84 runs along the length of the blank 94.

Various changes to the foregoing described and shown structures would now be evident to those skilled in the art. Accordingly, the particularly disclosed scope of the invention is set forth in the following claims.

What is claimed is:

1. A package assembly for enclosing and dispensing a plurality of consumable products comprising:

a package housing defining a pair of product pockets each having an open end for removable accommodation of a plurality of products in a row, said open ends of said pockets facing each other, the package housing including a back wall, the back wall comprising two opposed sides and two opposed ends; and the pockets being secured to the back wall;

said package housing further comprising a first and a second openable flap, the first flap having a length extending from a first of the two opposed sides toward a distal end of the first flap, and the second flap having a length extending from a second of the two opposed sides toward a distal end of the second flap; said first and second flaps being foldable over said first and second product pockets for overlying and enclosing said first and second pockets; and said package housing including a fold line extending along a longitudinal axis of the housing, the longitudinal axis and the fold line are positioned between said open ends of said pockets; the longitudinal axis and the fold line extend through the length of said first and second flaps; said back wall and said first and second flaps being foldable along said fold line to place said pockets in an angled orientation for dispensing of said product.

2. The package assembly as defined in claim 1, wherein the first flap overlies the second flap.

3. The package assembly as defined in claim 2, wherein the second flap includes a slot formed therein and the first flap includes a tab insertable into the slot to secure the first and second flaps in the closed position.

4. The package assembly as defined in claim 1, wherein the housing includes a pair of opposed side walls and the side walls form a bottom wall of the pockets.

5. The package assembly as defined in claim 1, wherein the fold line is perforated to permit the package housing to be separated apart into a first and second housing portion.

6. The package assembly as defined in claim 5, wherein the first housing portion includes a first closure for maintaining at least one of the first and second flaps in a closed position covering the pocket disposed on the first housing portion.

7. The package assembly as defined in claim 6, wherein the second housing portion includes a second closure for maintaining at least one of the first and second flaps in a closed position covering the pocket disposed on the second housing portion.

8. A consumable products package assembly comprising:

a package housing defining a pair of product pockets each having an open end for removable accommodation of a plurality of products, said open ends of said pockets facing each other, the housing including a back wall, the back wall comprising two opposed sides and two opposed ends; said package housing further comprising a first and second flap; the first and second flap being foldable to overlie and enclose the pair of pockets; and the first flap having a length extending from a first of the two opposed sides toward a distal end of the first flap, and the second flap having a length extending from a second of the two opposed sides toward a distal end of the second flap;

the package housing including a fold line extending along a longitudinal axis of the housing, the longitudinal axis and the fold line disposed between the open ends of the pockets; the longitudinal axis and the fold line extend through a length of the first and second flaps for folding the housing at the fold line; the housing having a first position wherein the pockets lie in a common plane and a second position wherein the housing including the back wall and the first and second flaps are foldable along the fold line so that the pockets are angularly offset from each other.

9. The package assembly as defined in claim 8, wherein the pockets each include a front wall bounded by two opposed side walls and a bottom wall, the front wall, side walls and bottom wall define a pocket interior.

10. The package assembly as defined in claim 8, wherein the fold line is perforated to permit the package housing to be separated apart into a first and second portion with each portion having one of the pair of product pockets.

11. The package assembly as defined in claim 8, wherein the pair of product pockets include a plurality of consumable product pieces.

12. The package assembly as defined in claim 11, wherein the product pieces extend beyond the pockets when fully seated therein.

13. The package assembly as defined in claim 11, wherein the housing is formed from a single unitary piece of material.

14. The package assembly as defined in claim 11, wherein the product pieces have a first end and a second end, the first end disposed within the pockets and the second end extending from the pockets.

15. The package assembly as defined in claim 11, wherein a first of the pair of product pockets includes a front wall bounded by two opposed side walls and a bottom wall; the front wall, side walls and bottom wall defining a pocket interior.

16. The package assembly as defined in claim 11, wherein the first and second flaps have a first position for overlying and enclosing the consumable product pieces and a second position wherein the product pieces are uncovered and accessible for dispensing.

17. The package assembly as defined in claim 11, wherein the package housing is separable into a first and second portion with each portion having one of the pair of product pockets.

18. The package assembly as defined in claim 17, wherein the package housing is separable along the fold line.

19. The package assembly as defined in claim 18, wherein the fold line is perforated to facilitate separation of the package housing into the first and second portion.

20. The package assembly as defined in claim 1, wherein the first and second flaps are each foldable about an axis generally perpendicular to the package housing longitudinal axis.

21. The package assembly as defined in claim 5, wherein the first housing portion includes a first of the pair of product pockets and a first portion of the first and second flaps and the second housing portion includes a second of the pair of product pockets and a second portion of the first and second flaps.

* * * * *